United States Patent [19]

Dice et al.

[11] 4,397,362

[45] Aug. 9, 1983

[54] DRILLING HEAD

[76] Inventors: Rodney L. Dice, 3077 Allendale; Jimmy E. Hillman, 6303 Raderville Rt.; Robert F. Dice, 233 Robin, all of Casper, Wyo. 82601

[21] Appl. No.: 240,985

[22] Filed: Mar. 5, 1981

[51] Int. Cl.[3] ..... E21B 10/60

[52] U.S. Cl. ..... 175/393; 175/410

[58] Field of Search ..... 175/350, 354, 355, 340, 175/348, 410, 413, 415, 393

[56] References Cited

U.S. PATENT DOCUMENTS

| | | | |
|---|---|---|---|
| 2,634,955 | 4/1953 | Johnson | 175/350 |
| 2,836,408 | 5/1958 | Barrett | 299/90 X |
| 2,915,291 | 12/1959 | Gulfett | 175/348 |
| 3,720,273 | 3/1973 | McKenry et al. | 175/354 |

*Primary Examiner*—Stephen J. Novosad
*Assistant Examiner*—Joseph Falk
*Attorney, Agent, or Firm*—Victor J. Evans & Co.

[57] ABSTRACT

A drilling head of the claw-type which eliminates the need for a pilot bit. The configuration to be described hereandafter causes the drill head to run more smoothly and straighter than those claw-type drills having a pilot. The structure includes a threaded stem portion for threadedly affixing the drilling head to a drive source, a platform extending from the stem portion upon which plural drill bits are affixed on a top face thereof in which the platform is formed from three sectors of pyramid shape, and the recess on the top face of the sectors is provided with further bits for cutting outside of the drill head itself.

10 Claims, 6 Drawing Figures

FIG 1
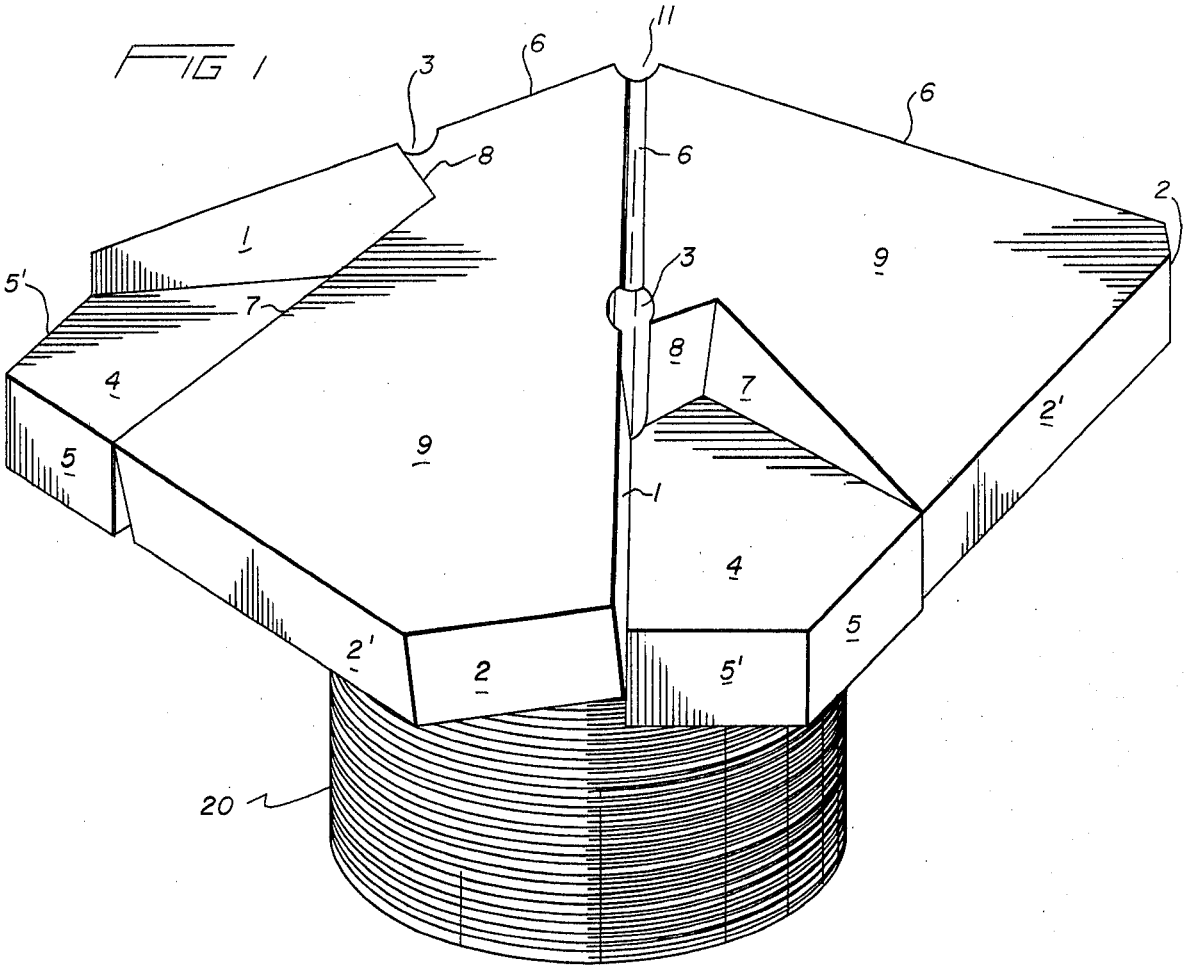
FIG 2
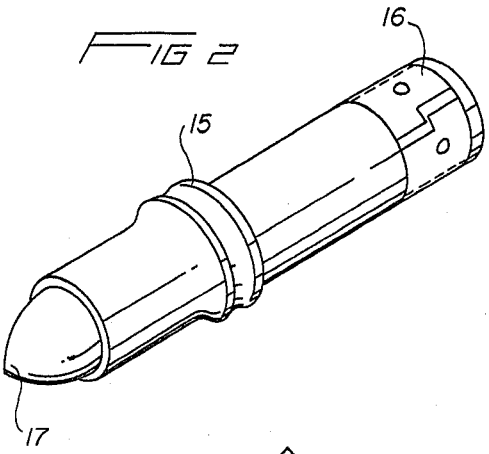
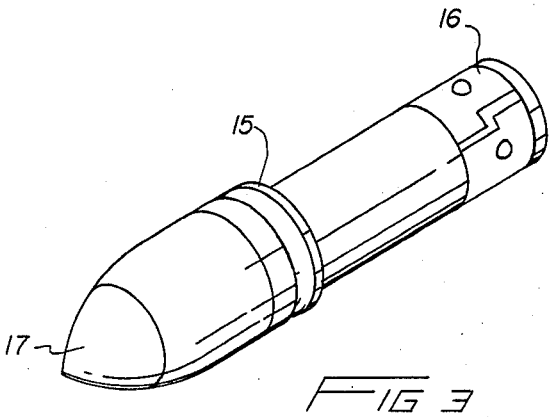
FIG 3
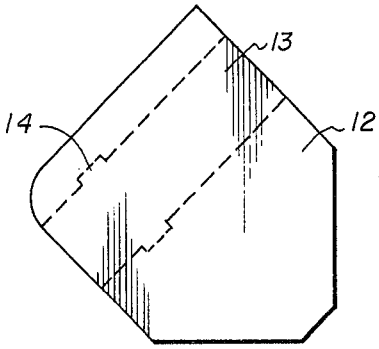
FIG 4

DRILLING HEAD

BACKGROUND OF THE INVENTION

This invention relates generally to claw-type drilling heads.

Conventional claw-type drilling heads require the use of a pilot bit, centrally disposed in order to keep the drill head from wandering.

The following patents reflect the state of the art which applicant is aware:

| | | | |
|---|---|---|---|
| D 225,075 | | 2,855,181 | Olsen |
| 2,650,071 | Rassieur | 3,269,471 | Alexander |

Olsen teaches the use of a drill bit in which a plurality of stepped cutting edges are provided in order to insure a straight hole.

Rassieur teaches the use of a mining drill comprised of two half-shank sections 8 provided with a hole 15 adapted to receive pins 4 for manipulation of each half-shank.

Alexander teaches the use of a rock drilling bit in which the contour of the cutting edges is such that the bit will be substantially clean or have a chip-free surface for cutting at all times.

Clearly, these prior art patents are not only structurally dissimilar but also functionally inefficient when compared to the instant invention as set forth hereandafter and as claimed.

OBJECTS AND SUMMARY OF THE INVENTION

Accordingly, this invention has as an object the provision of a claw-type drilling head which requires no pilot bit.

Another object of his invention is to provide a device of the character described above which drills with less vibration, faster with less heating, and has a longer sharp bit life.

It is yet another object of this invention to provide a device of the character described above with a novel cooling and tool head cleaning arrangement.

These and other associated objects will be made manifest when considering the ensuing detailed description when taken in conjunction with the appended drawing figures.

BRIEF DESCRIPTION OF THE DRAWING FIGURES

FIG. 1 is a perspective view of the cutting head with the bits and associated mounting blocks removed;

FIG. 2 is a perspective view of one form of drilling bit;

FIG. 3 is a view of a second form of drilling bit;

FIG. 4 is a side view of a mounting block commonly used with the drill bits of FIGS. 2 and 3;

DESCRIPTION OF THE PREFERRED EMBODIMENT

Figure 5:
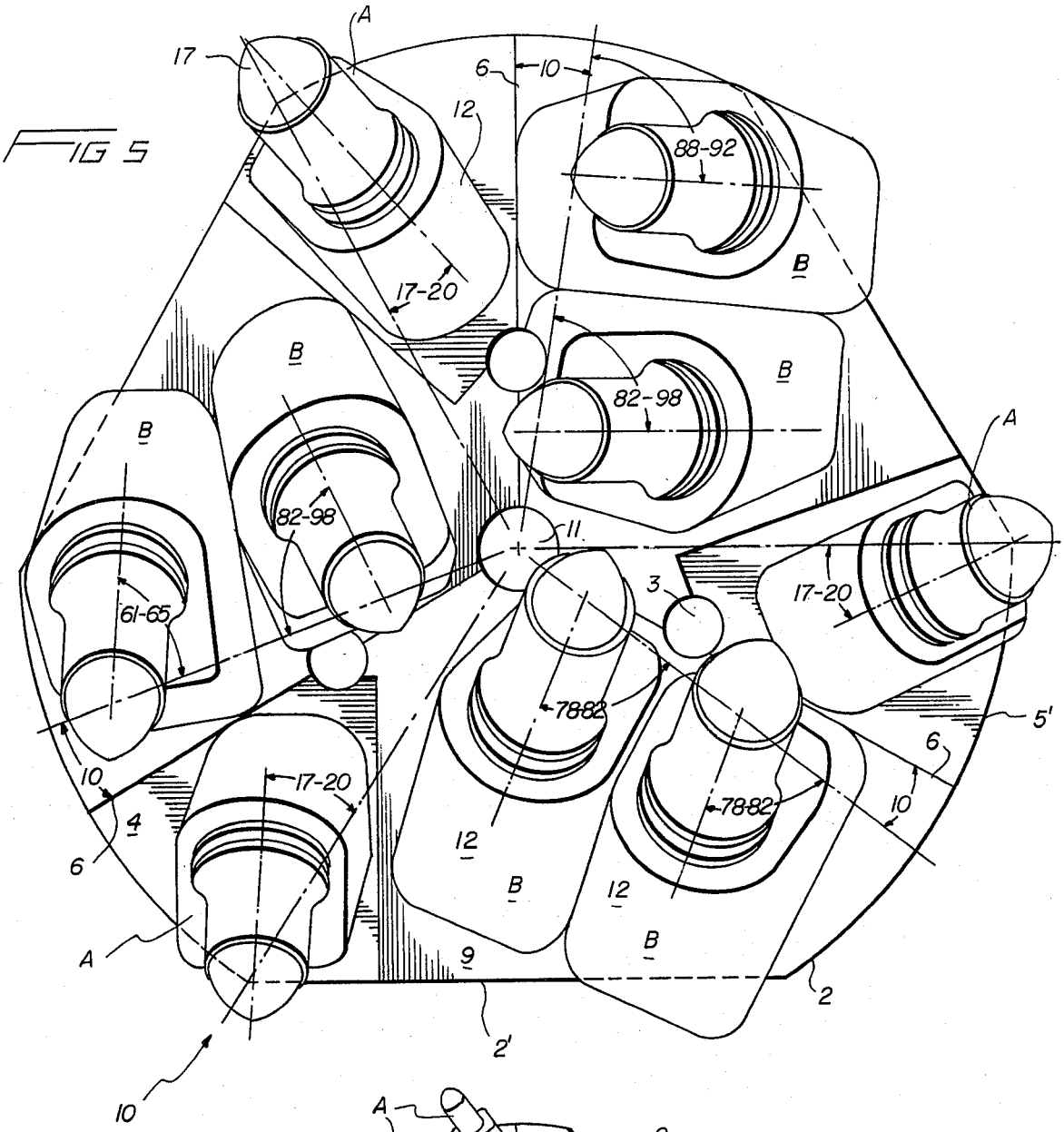
FIG. 5 is a top plan view of one drilling head and the associated preferred disposition of the drillings bits thereon.

Referring to the drawings now, wherein like reference numerals refer to like parts throughout the various drawings figures, reference numeral 10 refers to the drilling head according to the present invention.

The drilling head 10 as best seen in FIG. 1, includes a threaded stem portion 20 for threadedly affixing the head to a drive source (not shown) and extending upwardly therefrom a platform is provided. The platform is formed from three sectors each of pyramid shape and upwardly angled to meet at point 11, the geometrical configuration of this platform being such that no pilot drill is necessary. Each sector includes a major planar surface 9 angled upwardly and tapering to a center 11 of the drilling head 10 upon which surface plural drill bits 17 and their associated mounting block 12 are placed as by welding.

A lower corner of the major planar surface is provided with a recessed area 4 having an open end wall and side walls 1, 8 and 7. Interfaced between wall 1 and 8 is a passageway 3 that communicates with an access channel within the stem for carrying liquid therethrough, and the passageway 3 extends through the platform the passageway and once it has reached the top face of the platform communicates with a trough 6 extending from a top portion of the passageway 3 to the center 11 of the drilling head 10. The liquid serves to cool and clean the drill head during use.

As shown especially well in FIG. 5, the drill bits that are disposed upon the recessed area extend outwardly away from the platform and are suitably oriented to make an outside cut greater than to the diameter of the drilling head to allow passage of the drilling head through the surface being cut. The drill bits mounted on the major planar surface 9 are suitably disposed and oriented to provide cutting directly above the drilling head so as to remove material thereat and allow the drilling head to progress.

Figure 6:
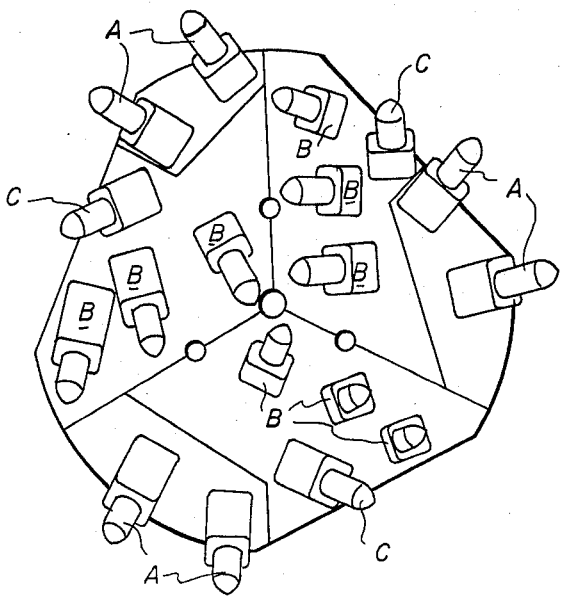
FIG. 6 is a top plan view of a second drill head having substantially more bits on the top portion thereof as an example of a further kind of drilling bit.

As shown in FIGS. 5 and 6, the drilling bits A designate those bits which cut outside of the drilling head, B denotes those bits which cut inside or above the drilling head, and as shown in FIG. 6, reference C denotes a bit disposed on the major planar surface which provides a cut intermediately the inside and outside.

The interior cutters B are placed substantially in a line which is 10° retarded from the joining area 6 of the various sectors. The angulation of the interior drill bits B vary relative to the center line of the drill bit and a radian, and those values listed in FIG. 5, while shown to be extremely effective, should not be construed as being limiting in any manner. The outside cutters A beneficially vary from 17° to 20° from the center line of the drill bit as it relates to the radian, as shown in the drawings.

As shown in FIGS. 5 and 6, if N drill bits are mounted on the major planar surface for inside cutting, N - 1 drill bits and mounting blocks are disposed in the recessed area for outside cutting. Additionally, when the dimensions of the cutting head are of sufficient magnitude, an intermediate cutting bit C is placed on the major planar surface extending over an edge thereof.

As shown in FIG. 1, each sector has a lower end wall formed by plural facets 5', 5, and 2', 2, all facets being uniquely angled and tapering downwardly and inwardly some to greater extent than others, in order to minimize any binding that may occur either in insertion of the head 10 or removal.

FIGS. 2 through 4 teach the use of typical drilling bits and a mounting block therefore which finds particular utility in this application. Specifically, the drilling bits have a pointed tip 17 and a substantially cylindrical body portion including an annular rib 15 disposed along the length of the body which nests upon a top edge of the mounting block 12. The mounting block 12 has a cylindrical hollow 13 adapted and dimensioned to receive the cutting bit, and a notch type recess 14 for reception therein of an expandable sleeve 16 whereby rotation of the sleeve 16 causes its disposition within the retention area 14, as is well known in the art.

In view of the foregoing, it should be clear that there has been provided a drilling head formed from three sectors each of which are substantially of pyramid shape and having an upwardly tapering contour so that the drill bits disposed upon the major face serve to attack substance to be drilled without the necessity of a pilot bit which is commonly found in all types of claw drill bits. The combination of the angulation of each sector and the reaction of the innermost drill bits makes the use of a pilot drill bit unnecessary.

Moreover, having thus described the invention, it should be apparent that numerous structural modifications are contemplated as being part of this invention as set forth hereandabove and described hereandbelow by the claims.

What is claimed is:

1. A claw-type drilling head devoid of a central pilot bit comprising, in combination:

(a) a threaded stem portion for threadedly affixing said head to a drive source, (b) a platform extending from said stem portion, (c) plural drill bits, (d) means for fixedly attaching said drill bits to said platform to rotate only therewith, said platform formed of plural sectors of pyramid shape, (e) means for cooling and cleaning said bits while drilling including a centrally disposed axially extending cooling and cleaning means.

2. The device of claim 1 wherein said drill bits are removable and wherein said means for attaching said drill bits comprises mounting blocks welded to said platform.

3. The device of claim 2 wherein each said sector includes a major planar surface angled centrally upwardly and tapering to a center of said drilling head upon which surface plural said drill bits and their associated said mounting blocks are placed for cutting axially above said platform in the direction of head advancement.

4. The device of claim 3 wherein said major planar surface is provided with a recessed area along a lower corner thereof upon which recess is provided drill bits and their associated mounting blocks, said drill bits oriented to cut above said platform slightly beyond an outer periphery of said drilling head for clearance.

5. The device of claim 4 in which N drill bits and mounting blocks are disposed on said major planar surface for inside cutting, and N - 1 drill bits and mounting blocks are disposed on said recessed area for outside cutting.

6. The device of claim 5 wherein a further drill bit is provided on said major planar surface for cutting intermediate the inside and outside.

7. The device of claim 6 wherein said means for cooling and cleaning said bits further comprise an access channel in said stem for carrying liquid therethrough, passageways extending through said platform communicating with said channel for further carrying the liquid and a trough extending from a top portion of said passageway to said center cooling and cleaning means of said drilling head.

8. The device of claim 7 wherein each of said sectors has a lower end wall formed by plural facets.

9. The device of claim 8 wherein said recessed areas included an open endwall and plural sidewalls, a said passageway provided for each said recessed areas at the conjunction of two said sidewalls.

10. The device of claim 9 wherein said troughs extend along radial lines between adjacent sectors, with three sectors provided.

* * * * *